United States Patent [19]

Ferton

[11] Patent Number: 4,488,913

[45] Date of Patent: Dec. 18, 1984

[54] METHOD FOR INTERRUPTED HARDENING OF ALUMINUM-BASE ALLOYS

[75] Inventor: Daniel Ferton, Grenoble, France

[73] Assignee: Societe de Vente de l'Aluminium Pechiney, Paris, France

[21] Appl. No.: 317,399

[22] Filed: Nov. 2, 1981

[30] Foreign Application Priority Data

Nov. 5, 1980 [FR] France ..... 80 23944

[51] Int. Cl.[3] ..... C22F 1/04

[52] U.S. Cl. ..... 148/12.7 A; 148/159; 148/417

[58] Field of Search ..... 148/12.7 A, 159, 32.5

[56] References Cited

U.S. PATENT DOCUMENTS 3,935,007 1/1976 Baba et al. ..... 148/12.7 A

FOREIGN PATENT DOCUMENTS 2810958 7/1979 Fed. Rep. of Germany ..... 148/143

*Primary Examiner*—R. Dean

*Attorney, Agent, or Firm*—Dennison, Meserole, Pollack & Scheiner

[57] ABSTRACT

The invention relates to a method for interrupted quenching of aluminum alloys with structural hardening.

It comprises, starting from solution annealing:

(a) rapid cooling by quenching until the product reaches a temperature of from 150° to 260° C.;

(b) stopping the quenching operation for a period of from a few seconds to some tens of minutes (air cooling), and (c) resuming quenching to ambient temperature.

Under these conditions, the result is quenched and tempered products which have mechanical characteristics close to state T6 and better than those of conventional state T73, with a very good degree of resistance to corrosion (flaking corrosion or stress corrosion) and a level of internal stresses which is substantially halved in comparison with conventional state T6.

This treatment can be applied to all aluminum alloys of the 2000, 6000 and 7000 series (in accordance with the A.A.).

13 Claims, 3 Drawing Figures

METHOD FOR INTERRUPTED HARDENING OF ALUMINUM-BASE ALLOYS

Figure 1:
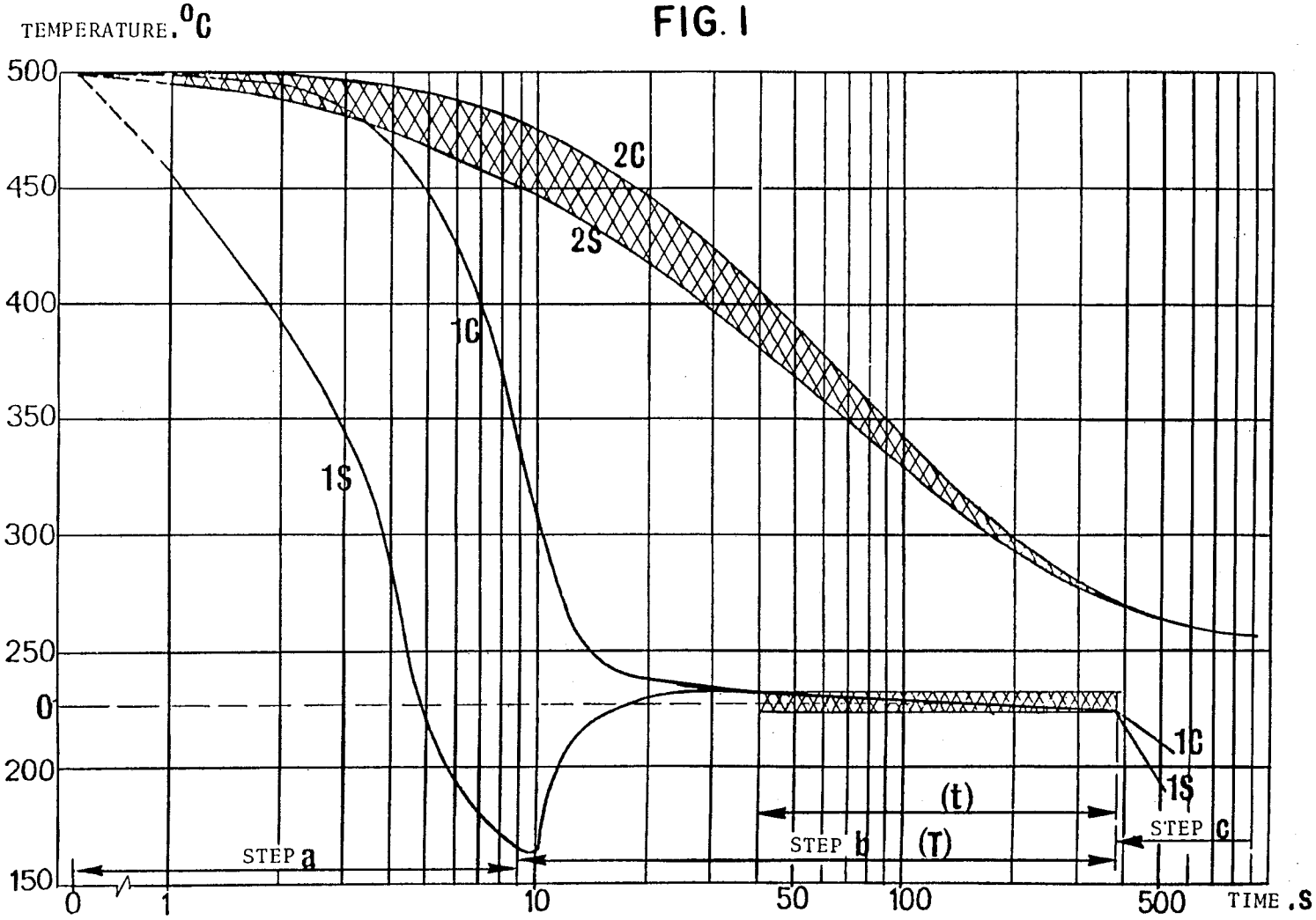

The invention relates to a method for interrupted quenching of aluminum alloys with structural hardening.

It is known that the production of improved mechanical characteristics in association with good levels of resistance to corrosion (intergranular corrosion, pitting corrosion) of alloys with structural hardening depends largely on the quality of the quenching operation; the quenching operation must be quick and vigorous. In fact, the aim is to avoid any harmful precipitation between approximately 400° C. and 260° C. by as short as possible a transfer time between dissolution and the commencement of quenching, followed by vigorous quenching (for example, moving cold water).

However, this procedure results in products which are severely deformed, with severe internal stresses; this results in the need for burdensome refinishing operations and frequently additional distortion phenomena for example in the final machining operation.

On the other hand, in order to improve resistance to stress corrosion, it is general practice to use over-tempering methods (double tempering on alloys of the 7000 series). These processes result in a not inconsiderable deterioration in mechanical strength properties.

The process according to the invention makes it possible to enhance the characteristic of corrosion resistance and to reduce the level of internal stresses in the products treated without a substantial modification in the mechanical strength characteristics. It comprises subjecting the products, after the dissolution treatment, to interrupted quenching comprising:

(a) a rapid cooling by quenching until the product reaches a temperature of from 150° to 260° C., (b) stopping the quenching operation for a period of from a few seconds to some tens of minutes (air cooling), and (c) resuming the quenching operation to ambient temperature.

The treatment is optionally completed by conventional operations of controlled compression or traction (relaxation) and/or tempering (hardening).

The quenching operation is carried out by (or in) a suitable fluid, preferably cold water, using any known means (sprinkling, immersion, spraying, air-water mist, etc.).

The products which have been treated in the above-indicated manner, in comparison with conventional treatments involving direct quenching, enjoy good corrosion resistance, in particular resistance to stress corrosion, possibly at the expense of a slight reduction in the mechanical tensile characteristics. On the other hand, the level of the residual stresses after quenching is greatly reduced.

The quenching operation is stopped by closing the sprinkling inlets in the case of quenching by sprinkling, or by removing the article from the quenching bath, in the case of immersion hardening.

In comparison with the step-quenching processes described in the technical literature, this method is distinguished by an interruption of and a resumption of the quenching operation, whereas stepped hardening comprises only a single quenching operation at an intermediate temperature between dissolution and ambient temperature in various known media (salt bath, oil bath, hot water).

In addition, in the method according to the invention, the mean speed of initial cooling (step a) is generally high and preferably higher than 3° C./second between the dissolution temperature and 260° C. Likewise, the mean speed of final hardening (step c) is preferably higher than 60° C./minute, between the temperature attained at the end of step (b) and 100° C.

It has also been observed that the duration and the position of the interruption in the quenching operation have a great influence on the optimum combination of mechanical and corrosion-resistance characteristics of the articles.

In this specification, we shall refer to duration of interruption (t) in step (b), not to denote the physical duration thereof (T), but to denote the duration between the moment at which the temperatures of the treated article are substantially uniform (temperature difference $\leqq 5°$ C.) and the moment of resuming the quenching step (step c). The interruption temperature ($\theta$) is the substantially uniform and constant temperature of the product in the last phase.

The effective surface temperature, upon interruption of the quenching operation (commencement of step b) and the effective duration thereof (T), which depend inter alia on the nature of the alloy, the shape and the size of the components, etc., are easily available to the person skilled in the art on the basis of experience, calculation or simulation.

Figure 2:
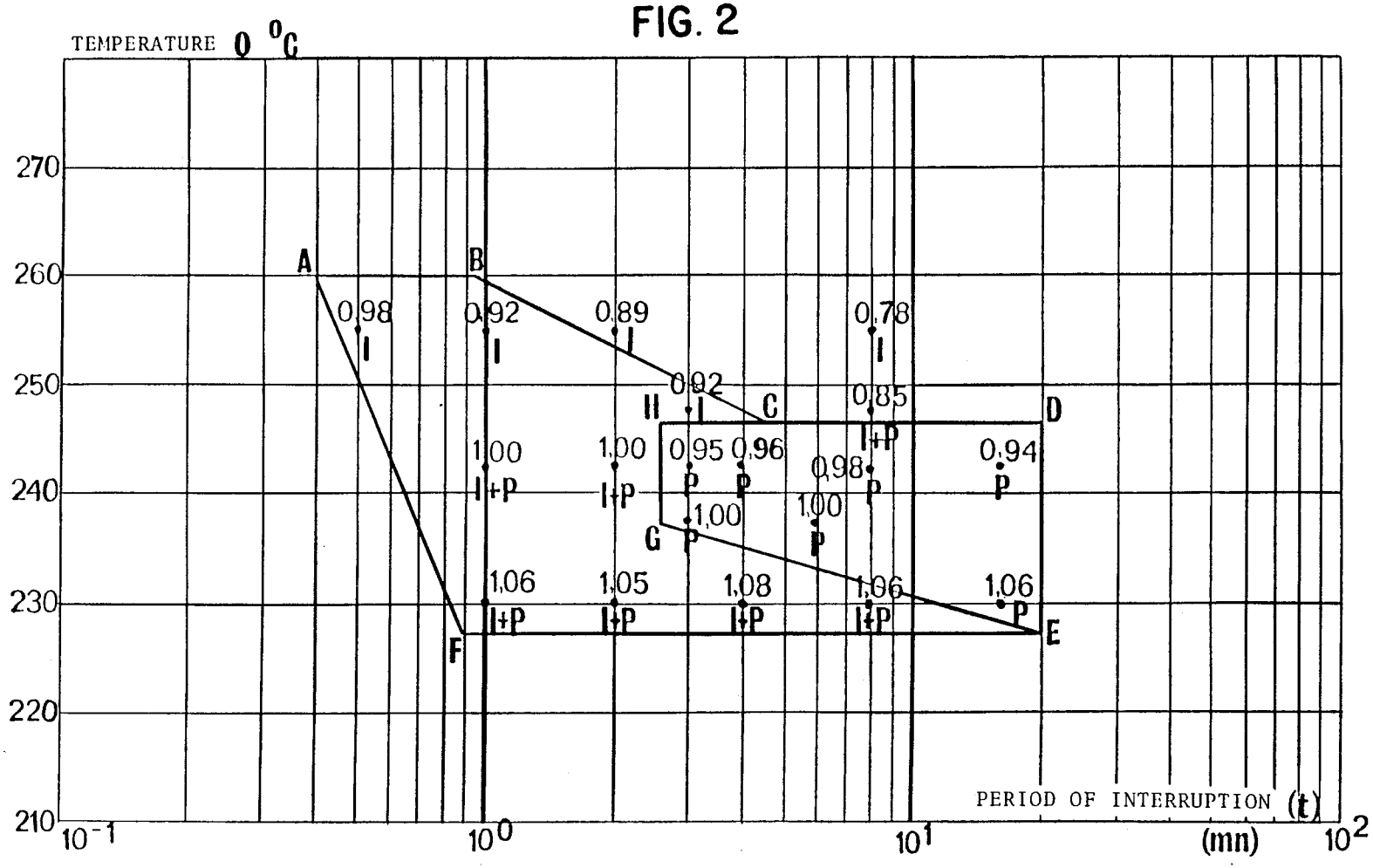

In regard to alloys of type 2214 which suffer from a very highly marked susceptibility to intergranular corrosion in the usual state T6, the interruption temperatures and durations within the perimeter line ABDCEF make it possible to improve resistance to corrosion (see FIG. 2). The interruption temperatures and durations preferably will be in the perimeter line CDEGH (see FIG. 2).

Figure 3:
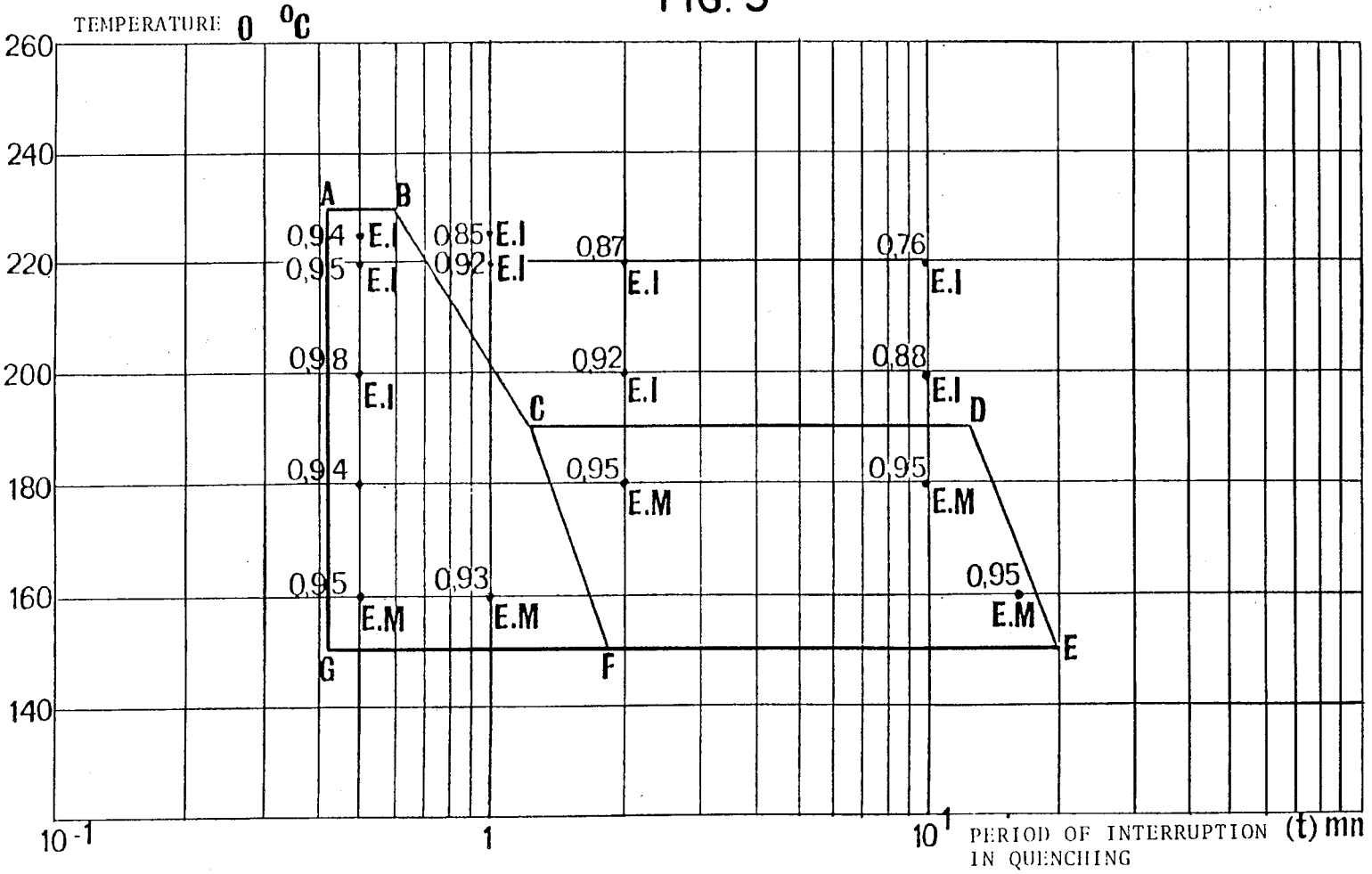

In regard to alloys of type 7475 which have a very high level of susceptibility to flaking corrosion in the usual state T6 with interruption temperatures and durations which are within the perimeter line ABCDEG, the resistance to flaking corrosion is improved, while only 5% of the hardness of state T6 is lost (FIG. 3).

Preferably, the interruption temperatures and durations within the perimeter line CDEF give the best results (see FIG. 3).

The polygonal perimeter lines which are traced out semi-logarithmic coordinates have apexes having the following coordinates:

| | FIG. 2 | | FIG. 3 | |
|---|---|---|---|---|
| Points | $\theta$ (°C.) | t (min) | $\theta$ (°C.) | t (min) |
| A | 260 | 0.40 | 230 | 0.42 |
| B | 260 | 1.0 | 230 | 0.60 |
| C | 247 | 4.5 | 190 | 1.2 |
| D | 245 | 20 | 190 | 12 |
| E | 228 | 20 | 150 | 20 |
| F | 228 | 0.9 | 150 | 1.8 |
| G | 237 | 2.5 | 150 | 0.42 |
| H | 247 | 2.5 | — | — |

The stresses involved can be relaxed after quenching by plastic traction of compression deformation and tempering is preferably carried out in the temperature range of from 130° to 170° C. for periods of time of from 7 to 15 hours for alloys of type 7075 and from 10 to 30 hours for alloys of type 2214.

The invention will be better appreciated and illustrated by the following examples and figures.

FIG. 1 shows the compared cooling curves of a product which is 60 mm in thickness, in a conventional step-quenching operation, and in accordance with the invention, and FIGS. 2 and 3 show the optimum conditions of interruption in the hardening treatment (as referred to hereinbefore).

FIG. 1 shows the variation in temperature of a plate of alloy 2214 which is 60 mm in thickness, being quench-hardened from a temperature of 500° C., on the one hand using the method of the invention by sprinkling for 9 seconds with cold water, stopping the sprinkling operation at about 220/230° C. for a period of 370 seconds (T) and resuming sprinkling, and on the other hand, using the conventional step-quenching method in a salt bath heated to a temperature of 250° C.

It will be seen that the surface curves (S) or the core curves (C) of the product are of very different configurations, in case 1 in accordance with the invention or case 2 in accordance with the prior art method.

Also shown in FIG. 1 are the values in respect of time (T,t) and temperature ($\theta$) as defined hereinbefore.

EXAMPLE 1

Metal sheets of type 2214 (in accordance with the specifications of the A.A.), 60 mm thick, were treated on the one hand using the conventional method with direct quenching with cold water and tempering (state T6), and on the other hand in accordance with the invention, by quenching with cold water from a temperature of 505° C., with the following interruptions: 5 minutes at 225°-230° C.; 8 minutes at 225-230° C.; 10 minutes at 205°-210° C., and tempering for 24 hours at a temperature of 150° C.

The results in respect of mechanical traction characteristics (in lengthwise direction, lengthwise transverse direction and short transverse direction), stress corrosion (short transverse direction) which is determined in accordance with standard AIR 9048, conductivity and residual stresses in the lengthwise direction (value of Rs) are set out in Table I.

This example therefore results in a product which has simultaneously: good resistance to stress corrosion; mechanical traction properties which are close to the conventional T6; and a reduction in the level of residual stresses by half.

Corrosion tests were carried out using plates of 2214 alloy, measuring 40×80×5 mm. The largest dimension is parallel to the rolling direction. After solution annealing at a temperature of 505° C., the plates were cooled to the temperature of the block at a speed of 26° C./second. Different interruption temperatures and durations were applied, and then the test pieces were subjected to tempering for 24 hours at 150° C. Taking those samples, and also a reference sample which had been hardened in conventional manner and treated, as T6, the Vickers hardness was measured, and also the degree of intergranular corrosion. The results corresponding to those tests are set out in FIG. 2. Above each experimental point appears the ratio of the Vickers hardness of the test to the Vickers hardness of the usual state T6. Below each point appears the index of corrosion, the means of which are as follows:

| | |
|---|---|
| I = integranular corrosion<br>P = pitting corrosion | in accordance with standard AIR 9050C |

It can be seen that the area DEGH corresponds to hardnesses which are almost equal to or greater than state T6 and to immunity from intergranular corrosion.

EXAMPLE 2

A metal plate of type 7475 (in accordance with the specifications of the A.A.), 60 mm thick, was treated on the one hand in accordance with the conventional process of cold water quenching and tempering (states T6 and T73) and on the other hand in accordance with the invention, by quenching with cold water from a temperature of 470° C., with an interruption for 6 minutes at 185° C., and tempering for 8 hours at 160° C. The results are set out in Table II.

This example results in a product which has both: mechanical traction properties which are better than state T73, and resistance to stress corrosion which is identical to state T73.

Corrosion tests were carried out on samples identical to those of Example 1, which were treated in a similar manner, except for the final tempering operation which was carried out at a temperature of 160° C. for a period of 8 hours.

These sample were subjected to a Vickers hardness test and a flaking corrosion test, in accordance with the standard ASTM G34/78.

The results of those tests are set out in FIG. 3. Above each experimental point appears the ratio of the Vickers hardness of the test to the Vickers hardness of the reference corresponding to state T6. Below each point appears the index of flaking corrosion (EM: moderate flaking corrosion; EI: intermediate flaking corrosion).

It will be noted that there is a substantial reduction in flaking corrosion, for a negligible loss of mechanical strength characteristics in the range in question.

The process according to the invention can be used for hardening all aluminum-base alloys with structural hardening, in particular alloys of the 2000, 6000 and 7000 series (using the nomenclature of the Aluminium Association).

TABLE I

| | ALLOY 2214 | | | | | | | | | | | |
|---|---|---|---|---|---|---|---|---|---|---|---|---|
| | MECHANICAL CHARACTERISTICS | | | | | | | | | STRESS CORROSION | | RESIDUAL STRESS |
| | L* | | | TL* | | | TC* | | | | | |
| PROCESS | R 0.2 MPa | Rm MPa | A % | R 0.2 MPa | Rm MPa | A % | R 0.2 MPa | Rm MPa | A % | AT 200 MPa TC* | CONDUCTIVITY % IACS | Rs (MPa) L* |
| Conventional hardening state T6 | 435 | 487 | 11.7 | 431 | 480 | 8.9 | 422 | 471 | 3.8 | Broken after two days | 38.5 | 87 |
| Interruption 5 min at 225-230° C. + tempering for 24 hours | 433 | 477 | 9.4 | 399 | 453 | 7.5 | 396 | 449 | 4.3 | Unbroken at 30 days | 40.2 | 44 |

TABLE I-continued

| PROCESS | ALLOY 2214 MECHANICAL CHARACTERISTICS L* R 0.2 MPa | L* Rm MPa | L* A % | TL* R 0.2 MPa | TL* Rm MPa | TL* A % | TC* R 0.2 MPa | TC* Rm MPa | TC* A % | STRESS CORROSION AT 200 MPa TC* | CONDUCTIVITY % IACS | RESIDUAL STRESS Rs (MPa) L* |
|---|---|---|---|---|---|---|---|---|---|---|---|---|
| at 150° C. | | | | | | | | | | | | |
| Interruption 8 min at 225–230° C. + tempering for 24 hours at 150° C. | 368 | 431 | 9.2 | 312 | 410 | 10.0 | 370 | 431 | 3.7 | Unbroken at 30 days | 40.9 | 41 |
| Interruption 10 min at 205–210° C. + tempering for 24 hours at 150° C. | 435 | 484 | 10.3 | 417 | 471 | 8.1 | 413 | 463 | 4.0 | Unbroken at | 38 | 49 |

L*: lengthwise direction
TL: lengthwise transverse direction
TC: short transverse direction

TABLE II

| PROCESS | ALLOY 7475 MECHANICAL CHARACTERISTICS L* R 0.2 MPa | L* Rm MPa | L* A % | TL* R 0.2 MPa | TL* Rm MPa | TL* A % | TC* R 0.2 MPa | TC* Rm MPa | TC* A % | STRESS CORROSION TC* DIRECTION UNDER A STRESS OF 300 MPa | 175 MPa | CONDUCTIVITY % IACS |
|---|---|---|---|---|---|---|---|---|---|---|---|---|
| Conventional hardening State 6 | 492 | 567 | 10 | 489 | 558 | 12.5 | 465 | 541 | 9.2 | Broken after 1 day | | 34.3 |
| Conventional hardening State T73 | 424 | 498 | 1.3 | 425 | 498 | 14.0 | 404 | 482 | 11.0 | Unbroken after 30 days | | 42 |
| Interruption 6 min at 185° C. | 443 | 528 | 11.1 | 444 | 527 | 12.8 | 422 | 508 | 9.7 | Unbroken after 30 days | | 38 |
| Tempering for 8 hours at 160° C. | | | | | | | | | | | | |

*L: Lengthwise direction
TL: Lengthwise transverse direction
TC: Short transverse direction

I claim:

1. A process for heat treatment of aluminum alloy product to effect structural hardening, an improved degree of resistance to flaking corrosion and stress corrosion, and a reduced level of internal stress, comprising the steps of a solution annealing, a quenching operation, and at least one tempering operation, wherein the quenching operation comprises the sequential steps of:

(a) cooling of the product from the solution temperature at an average speed greater than 3° C./second to bring the surface of the product to a temperature in the range of from about 150° to about 260° C. in a cooling medium or with a cooling agent, the temperature of which cooling medium or agent is lower than a temperature ($\theta$) defined in step (b);

(b) interrupting cooling so as to allow the surface temperature of the product to increase and to establish a substantially uniform surface to core temperature ($\theta$) of the product, which is in the range of from about 150° to about 260° C., for a duration of interruption (t) ranging from a few seconds to some tens of minutes; and (c) resuming cooling of the product to bring the product to ambient temperature which resumption of cooling is at an average speed of greater than 60° C./minute, during cooling between the temperature ($\theta$) attained in step (b) and 2. A process according to claim 1 wherein the cooling operation of step (a) is effected by water cooling and that of step (c) is effected by water cooling.

3. A process according to claim 1 wherein the cooling operation of step (a) is effected by water cooling and that of step (c) is effected by air cooling.

4. A process according to claim 2 or claim 3 wherein the water is at a temperature of less than 40° C.

5. A process according to claim 1 wherein the hardened products are subsequently subjected to a controlled traction or compression operation and/or tempering.

6. A process according to claim 1 wherein for alloys of type 2214, the durations (t) and temperatures ($\theta$) of the interruption in the quenching operation (step b) are within the perimeter lines ABCDEF in FIG. 2.

7. A process according to claim 6 wherein the durations (t) and temperatures ($\theta$) are within the perimeter line CDEGH in FIG. 2.

8. A process according to claim 6 or 7, wherein the products are subsequently subjected to a tempering operation for between 10 hours and 30 hours in a temperature range of from 130° C. to 170° C.

9. A process according to claim 1 wherein for alloys of type 7075, the interruption durations (t) and temperatures ($\theta$) are within the perimeter line ABCDEF in FIG. 3.

10. A process according to claim 9 wherein the durations (t) and temperatures ($\theta$) are within the perimeter line CDEF in FIG. 3.

11. A process according to claim 9 or 10 wherein the products are subsequently subjected to a tempering operation for from 7 hours to 15 hours in a temperature range of from 130° C. to 170° C.

12. The product produced by the process of claim 1, 2, 3, 5, 6, 7, or 10 wherein the product essentially comprises from 4 to 8% zinc, from 1.5 to 3.5% magnesium, from 1 to 2.5% copper and from 0.5 to 0.30% of at least one element selected from the group comprising chromium, manganese and zirconium and the balance aluminum, said product having a level of resistance to stress corrosion which is identical to that of state T73 and mechanical strength which is close to state T6.

13. A product produced by the process of claim 1, 2, 3, 5, 6 or 7, wherein the product essentially comprises from 2 to 5% copper, from 0.2 to 2.0% magnesium, from 0.2 to 1.0% manganese, from 0.1 to 1.0% silicon, and the balance aluminum, said product having a level of resistance to stress corrosion which is markedly better than that of state T6, with equivalent mechanical strength.

* * * * *